United States Patent [19]

James

[11] Patent Number: 4,742,588

[45] Date of Patent: May 10, 1988

[54] LIFTING SLING

[75] Inventor: David R. James, Glenyard, Great Britain

[73] Assignee: Impro Limited, Gloucester, England

[21] Appl. No.: 83,636

[22] Filed: Aug. 7, 1987

[30] Foreign Application Priority Data

Aug. 15, 1986 [GB] United Kingdom ..... 8619894

[51] Int. Cl.[4] ..... A61G 7/10

[52] U.S. Cl. ..... 5/83; 5/89

[58] Field of Search ..... 5/81 R, 82 R, 83, 86, 5/, 87, 89, 122, 123

[56] References Cited

U.S. PATENT DOCUMENTS 841,702 1/1907 Martin ..... 5/89

2,489,828 11/1949 Springer ..... 5/82 R 3,158,875 12/1964 Fletcher ..... 5/82 R

FOREIGN PATENT DOCUMENTS 2461492 3/1981 France ..... 5/83

*Primary Examiner*—Alexander Grosz

*Assistant Examiner*—Michael F. Trettel

*Attorney, Agent, or Firm*—Collard, Roe & Galgano

[57] ABSTRACT

A one-piece lifting sling for use with an invalid hoist has an upper end head-support extension which extends beyond attachment points of upper suspension means. The sling also has at least one pocket extending substantially throughout the extension and for a distance beyond a line joining the attachment points, a removable sheet or strip of substantially rigid but resiliently flexible material being housed in the pocket to provide the required head support.

11 Claims, 1 Drawing Sheet

LIFTING SLING

BACKGROUND OF THE INVENTION

1. Field of the Invention

The invention relates to lifting slings for use with invalid hoists, and is particularly concerned with one-piece lifting slings for that purpose. Such slings support the back and thighs of a patient, being suspended from the hoist by detachable suspension means such as chains, straps or the like.

2. Description of the Prior Art

One-piece lifting slings are formed from flexible material, conveniently a synthetic textile fabric, which conforms to the body shape and four-point attachment of the suspension means is required, two at the sides of the sling in the shoulder region and two others at the bottom end of the sling. Thus the invalid's body is comfortably cradled and supported from the shoulder downwards, but the head is left unsupported. As will be appreciated, for some patients head support is required at all times whilst for others the head needs to be supported during initial lifting from a supine position.

It is possible to extend the sling upwardly beyond the shoulder attachment points to provide head support, but this sling extension has in the past required two further suspension means at the head region. As will be appreciated, due to the flexibility of the sling the head extension receives no support from the shoulder region suspension means. Alternatively a separate head support sling has in some cases been fitted when required, and again two corresponding suspension means have been required for the head support sling. Thus, in either case head support has necessitated the employment of two additional suspension means for the sling. In view of the complexity which these additional suspension means represent, the usual practice is to use a standard one-piece sling, with four suspension attachments, and for a nurse to support the head of the invalid by hand when this is required. Not only does this place an additional demand on nursing personnel but it has the inevitable result that the head is often not supported when desirably it should be.

SUMMARY OF THE INVENTION

The object of the invention is to provide a one-piece sling which provides head support without requiring the provision of head suspension means from the hoist.

To this end, according to the invention, a one-piece sling has an upper end head-support extension beyond the attachment points of upper suspension means, the sling having at least one pocket extending substantially throughout the extension and for a distance beyond a line joining said attachment points, a removable sheet or strip of substantially rigid but resiliently flexible material being housed in the pocket to provide the required head support.

It will be appreciated that without the sheet or strip of the invention the upper suspension means would not provide any support for the flexible fabric of the sling above said line joining the upper attachment points, which is a line of tension in the fabric. The removable sheet or strip acts as a strut which supports the fabric providing the head-support extension above that line and which, at its lower end, in use reacts against the upper back of the supported invalid.

Preferably the sling has two spaced pockets each containing a removable strip of said substantially rigid but resiliently flexible material and which together span the width of the head support extension engaged by the head of a supported invalid. The use of two spaced strips facilitates folding of the sling when not in use, and they act as separate support struts capable of supporting the fabric between them in tension.

The sling of the invention is conveniently employed with an invalid hoist as disclosed in my co-pending U.S. application No. 934,786, now U.S. Pat. No. 4,712,257 which has a lifting arm and a sling hanger mounted to turn about a rigid vertical axis at the outer end of the arm, the hanger being a unitary construction pivotable about a horizontal axis and presenting a first pair of sling attachment points disposed to one side of the horizontal axis and a second pair of sling attachment points disposed on the opposite side of that axis. In this case the suspension means attached at the shoulder region of the sling are attached to one of the pairs of attachment points, and the suspension means connected to the lower end of the sling are attached to the other pair of attachment points. This, with the sling of the present invention, provides an arrangement in which the orientation of the invalid, whilst supported by the sling, can be varied about said horizontal axis with the head of the invalid satisfactorily supported in all positions.

The sling preferably comprises a main portion which supports the body of the invalid and from which the head support extension extends at the upper end, and lower end dependent leg support portions which in use respectively extend beneath and upwardly between the thighs of the invalid and the ends of which are attached to the corresponding suspension means. One-piece slings are presently manufactured from a flat fabric sheet and for increased comfort the sling of the invention is conveniently provided with darts or otherwise tailored so that it conforms more readily to the body shape of a supported invalid.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilizing the same or equivalent principles may be used and structural changes may be made as desired by those skilled in the art without departing from the present invention and the purview of the appended claims.

DESCRIPTION OF THE PREFERRED EMBODIMENT

Figure 1:
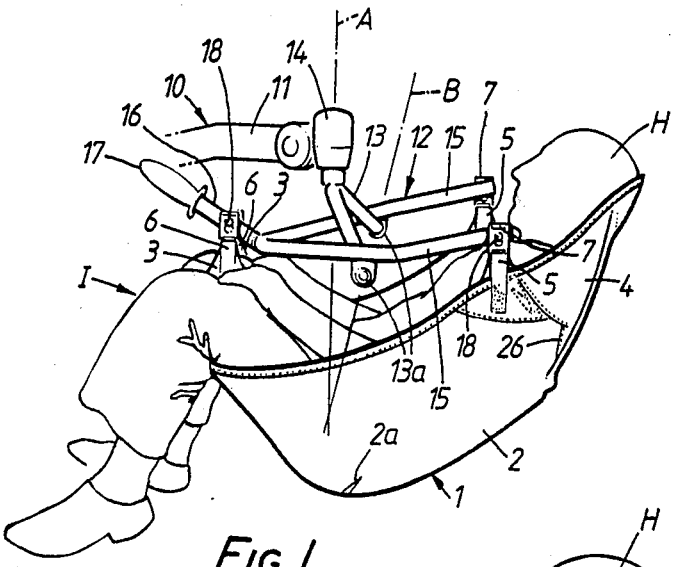
FIG. 1 is a side perspective view illustrating a one-piece sling providing head support in accordance with the invention and shown in use with a supported invalid.

The one-piece sling 1 illustrated comprises a main back portion 2 with lower end dependent leg support portions 3 and an upper end head support extension 4. The main portion 2 supports the back and shoulders of a suspended invalid I with the portions 3 respectively extending beneath and up between the thighs of the invalid whose head H is supported by the extension 4. Short extension tapes 5 providing suspension means are permanently stitched to the main portion 2 in the shoulder regions thereof, and suspension tapes 6 are similarly stitched to the ends of the sling portions 3.

The sling 1 is manufactured from a sheet of synthetic textile fabric, and it is tailored to conform more closely to the shape of the body of the invalid I and thus provide increased comfort for the latter. To this end the lower end of the back portion 2 has three darts 2*a*, and the upper end of this portion has two darts 2*b* in the neck region.

The sling is illustrated in the drawings as used with a hoist 10 having a cantilever lifting arm 11 supporting a sling hanger 12 of unitary construction and from which the sling 1 is directly suspended. Only the outer end of the lifting arm 11 is shown, and the hanger 12 is connected to the arm 11 through a forked connection 13. The connection 13 is mounted in a bearing 14 providing a vertical pivotal axis A at the end of the arm 11 and it is pivotally connected to the hanger 12 at points 13*a*. The arrangement is thus such that the hanger 12 can turn about the rigid vertical axis A at the outer end of the arm 11, with the hanger 12 and the connection 13 turning as one about this vertical axis, and the hanger 12 is pivotable on the connection 13 about a transverse horizontal axis B defined by the pivot points 13*a*.

The hanger 12 is of symmetrical form with spaced arms 15 which respectively pivot on the connection 13 and which at their free ends provide a pair of spaced sling attachment points to which the tapes 5 are attached. At the other end the hanger 12 has a central rod 16 terminating in a handgrip 17 and presenting, on opposite sides, a second pair of sling attachment points to which the suspension tapes 6 are attached. As can be seen from FIG. 1 this arrangement, with the close coupling of the sling 1 to the hanger 12 which the short suspension tapes 5 and 6 provide, results in a balanced arrangement in which the orientation of the suspended invalid I can be changed by pivoting about the horizontal axis B. Such pivotal movement is easily effected by an attendant grasping the handgrip 17.

Figure 2:
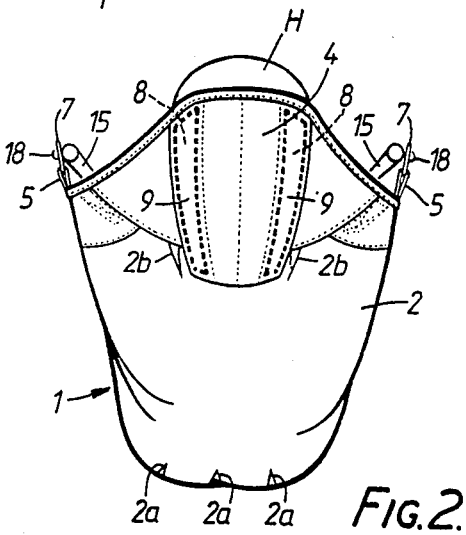
FIG. 2 is a corresponding rear view.

As can be seen from FIG. 2 the suspension tapes 5 and 6 are doubled over and passed through respective connecting elements 7 in the form of key-hole plates which hook on to headed attachment studs 18 providing the respective attachment points on the hanger 12. The required support for the head-support extension 4 of the sling 1 is provided by two strips 8 of substantially rigid but resiliently flexible plastics material contained in stitched pockets 9. These pockets extend from the upper end of the extension 4 for a distance beyond a line joining the points of attachment of the suspension tapes 5 to the sling 1 and they are open at their lower ends to allow removal of the strips 8 for laundering of the sling 1. With the strips 8 inserted the open lower ends of the pockets 9 are closed by a flap 9*a* with a Velcro (RTM) type fastening.

It will be appreciated that from the functional point of view of support of the head extension 4 the strips 8 should be of maximum rigidity, whereas from the comfort point of view they should be sufficiently flexible to conform to the shape of the invalid and in particular support the head in a cradled fashion. Thus the cross-section and material of these strips should be chosen to provide a satisfactory compromise between these somewhat conflicting requirements. It has been found, for example, that with a head extension 4 of 360 mm satisfactory support is provided by strips 8 formed of polypropylene 400 mm long x 50 mm wide×3 mm thick.

Figure 3:
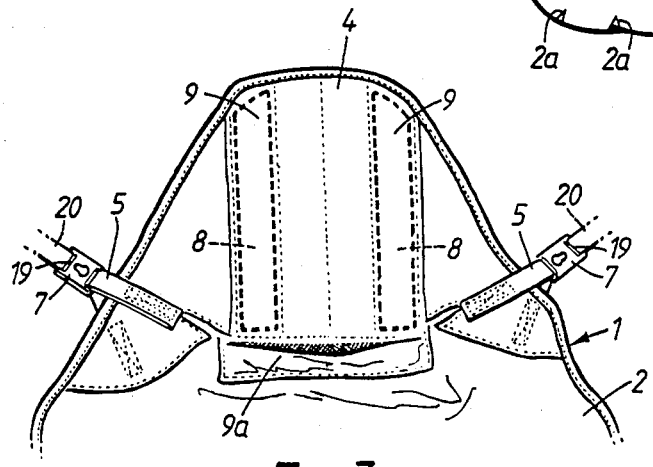
FIG. 3 illustrates an upper end portion of the sling viewed from the front or inner side.

The short suspension tapes 5 and 6 and the form of the connecting elements 7 provide both the close coupling described and easy attachment/detachment of the sling 1 when used with the sling hanger 12 arrangement shown in the drawings. FIG. 3 illustrates how these suspension means can be lengthened for use with other attachment arrangements. To this end each keyhole plate 7 has a normally redundant through slot 19 through which an extension tape 20 can be threaded.

What is claimed is:

1. A one-piece lifting sling for use with an invalid hoist, comprising two upper suspension means having attachment points in a shoulder region of the sling, two lower suspension means adjacent a bottom end of the sling, an upper end head-support extension extending beyond said attachment points of the upper suspension means, at least one pocket extending substantially throughout said extension and for a distance towards said bottom end of the sling beyond a line joining said attachment points, and a removable sheet or strip of substantially rigid but resiliently flexible material which is housed in the pocket so as to form a head support for a supported invalid.

2. A sling according to claim 1, wherein said pocket is one of two pockets spaced laterally of the sling and each containing a removable strip of said substantially rigid but resiliently flexible material, the two pockets together spanning the width of the head support extension when it is engaged by the head of a supported invalid.

3. A sling according to claim 1, wherein said substantially rigid but resiliently flexible material is a plastic material.

4. A sling according to claim 3, wherein said removable strip of substantially rigid but resiliently flexible plastic material is approximately 400 mm long×50 mm wide×3 mm thick.

5. A sling according to claim 1, in combination with a sling hanger pivotable about a horizontal axis and presenting a first pair of sling attachment points disposed to one side of the horizontal axis and a second pair of sling attachment points disposed on the opposite side of the axis, with the upper suspension means at the shoulder region of the sling being attached to one of the pairs of attachment points, and said suspension means at the lower end of the sling being attached to the other pair of attachment points.

6. A sling according to claim 1, wherein the sling comprises a main portion which supports the body of an invalid, and lower end dependent leg portions which in use respectively extend beneath and upwardly between the thighs of an invalid.

7. A sling according to claim 1, wherein the sling is provided with darts or otherwise tailored so that it conforms more readily to the body shape of the invalid.

8. A sling according to claim 1, wherein the suspension means of the sling comprise short suspension tapes permanently secured to the sling and terminating in attachment members adapted to hook on to the attachment points of a sling hanger.

9. A sling according to claim 1, wherein said suspension means comprise short suspension tapes permanently secured to the body of the sling and terminating in attachment members which comprise keyhole plates adapted to hook on to headed studs which form attachment points of a sling hanger.

10. A sling according to claim 1, wherein said suspension means comprise short suspension tapes permanently secured to the body of the sling and terminating in attachment members which comprise keyhole plates adapted to hook on to headed studs which form attachment points of a sling hanger, said keyhole plates having slots through which extension tapes can be threaded to extend the length of the suspension means of the sling.

11. A sling according to claim 1 wherein said strip of substantially rigid but resiliently flexible material is polypropylene.

* * * * *